US005144700A

United States Patent [19]

Martin

[11] Patent Number: 5,144,700

[45] Date of Patent: Sep. 8, 1992

[54] SELF CLEANING TOILET FLUSH TANK MONITOR WITH A FLEXIBLE MOUNT

[76] Inventor: Michel M. Martin, 1551 Southgate Ave., #140, Daly City, Calif. 94015

[21] Appl. No.: 621,306

[22] Filed: Dec. 3, 1990

[51] Int. Cl.[5] ..... E03D 1/00; G08B 21/00

[52] U.S. Cl. ..... 4/415; 4/314; 4/363; 340/624

[58] Field of Search ..... 4/415, 314, 363; 340/620, 623, 624; 200/84 R; 73/307, 308, 319, 322

[56] References Cited

U.S. PATENT DOCUMENTS

| | | | |
|---|---|---|---|
| 912,970 | 2/1909 | Marsh . | |
| 3,359,799 | 12/1967 | Lubin | 73/308 |
| 3,365,710 | 1/1968 | Duplessy . | |
| 3,984,877 | 10/1976 | Kirby | 4/314 |
| 4,011,553 | 3/1977 | Barri | 4/314 |
| 4,014,010 | 3/1977 | Jinotti . | |
| 4,255,747 | 3/1981 | Bunia | 200/84 R |
| 4,685,332 | 8/1987 | Betterton et al. | 73/308 |
| 4,993,086 | 2/1991 | Palmer | 4/415 |

*Primary Examiner*—Daniel M. Yasich

*Attorney, Agent, or Firm*—Heller, Ehrman, White & McAluliffe

[57] ABSTRACT

A water monitor for a toilet flush tank includes a sensing system and an alarm system. The sensing system includes a tube having a constricted aperture in the base. The tube is normally filled with water. When the flush tank is emptied water begins to drain slowly from the tube. A float in the control tube responds to the water level in the tube. A contact attached to the float closes contacts on the control tube if the flush tank does not refill. The closing of the contact is used to trigger an alarm signal. The monitor includes a self cleaning drainage aperture for the control tube and a flexible mounting belt which provides for simple mounting and adjustment.

8 Claims, 2 Drawing Sheets

SELF CLEANING TOILET FLUSH TANK MONITOR WITH A FLEXIBLE MOUNT

BACKGROUND OF THE INVENTION

The present invention pertains generally to a water level monitors for toilet flush tanks. It is directed specifically to a self cleaning water level sensor and a flexible mounting system for adjusting the position of the monitor in the flush toilet.

Conventional toilets used in apartments and hotel rooms comprise a water flush tank and a bowl. Water is stored in the flush tank. The flush tank has an aperture in its base. A pipe connects the aperture to the bowl. The aperture is normally sealed by a ball valve or a flap valve. Water is admitted to the tank through an inlet valve. The inlet valve is controlled by an arm which is attached to the inlet valve at one end, and to a float member at the other end. To flush the toilet the ball valve is lifted allowing water to flow rapidly through the pipe into the bowl. When the tank is empty the ball valve falls back into position and reseals the aperture. When the tank is empty the level of the float which operates the inlet valve is lowered. The lowering of the float opens the water inlet valve and the tank begins to refill. When the float reaches the original level the water inlet valve is closed and the flushing cycle is thus complete. About 5 gallons of water may be used to flush a toilet bowl.

A common malfunction of the conventional flush toilet system occurs when the ball valve does not correctly reseat after the toilet is flushed. Water may thus drain continuously from the tank as quickly as it is admitted through the water inlet valve and the tank can not refill to the original level. The float attached to the inlet valve can also not return to its original position. The inlet valve may thus remain open and water may continue to flow until the malfunction is corrected. The malfunction may not be detected for several minutes, or even for several hours.

The refill time for a normally functioning flush system may be about two minutes. If a malfunction were not detected for an hour the water flow would be the equivalent of thirty toilet flushes which may be more than would occur in a household in one day.

Since the invention of the flush toilet mechanism the design of toilets has progressed to the point where they are aesthetically more pleasing as well as more efficient in operation. Modern ceramics have replaced the original iron tanks. Toilet bowls have been designed which may be effectively flushed with less water. The basic flushing mechanism however is essentially the same. Furthermore, the components of the flushing mechanism have been made lighter and less substantial, generally in the interest of cost reduction. Thus, despite the overall design, progress the incidence of malfunctions of the flush system have not decreased and may even have increased.

Several monitor systems for toilet flush systems have been proposed. The purpose of the systems is to produce an audible or visible indication of a flush system malfunction. U.S. Pat. No. 3,365,710, granted to M.C. Duplessey, describes a system based on a mercury switch attached to the actuating arm of a water inlet valve mechanism. The system relies on an electrical delay circuit to determine if the arm is operating consistent with the proper refill rate for the flushing tank. U.S. Pat. No. 4,011,553, granted to D. Barri, describes a system which relies on electrodes submerged in the water in the toilet flush tank. An upper set of electrodes detects the full level of the tank and a lower set of electrodes detects the lowest level of water in the tank.

U.S. Pat. No. 3,984,877, granted to Kirby, describes a monitor system based on a fluid delay circuit. A control tube is inserted, substantially vertically, in the flush tank. The control tube has apertures in the upper portion which allows the water in the flush tank to flood the control tube. Thus, when the flush tank is full, the water level in the tube is the same as the water level in the flush tank. The control tube also has a relatively small aperture in its base. When the flush tank is emptied at the beginning of the flush cycle water drains from the tank faster than it drains from the control tube through the aperture in the base. A float in the control tube is equipped with an electrical contact. The float and thus the electrical contact fall toward an another electrical contact as the water level in the control tube falls during a flush cycle. If the ball valve in the flush tank seals normally after the flush, the water level in the tank rises and prevents further fall of the float. If the flush tank does not refill, the float continues to fall. The electrical contact attached to the float then electrically connects a pair of contacts attached to the control tube. The connecting of the contacts closes a circuit which in turn creates an electrical signal which may be used to activate an alarm. The alarm may be audible, such as a buzzer, or may be a visible alarm such as a flashing signal light.

All of the above described monitor systems are apparently simple and effective. None of the systems, however, has found widespread commercial use. A possible reason is that while the systems are sound in principle, they are still, as far as the potential domestic user is concerned, relatively complicated to install and calibrate. Furthermore, for such systems to be useful, they must be reliable. The conditions inside a toilet flush tank however are not conducive to reliable operation. Mineral deposits may quickly build up on objects immersed in the flush tank. The slightly acid nature of untreated water from the typical domestic supply may corrode metal objects immersed in it.

To be acceptable for domestic use a water monitor device should be inexpensive. It should be easily installed, preferably without the use of tools. It should be simple to adjust, and above all, once installed and adjusted, it should function reliably, requiring no further adjustment or maintenance.

Of the above referenced systems the Kirby system comes closest to meeting the requirements of a commercially-acceptable system. Kirby, however, identifies a problem of mineral deposits in the drainage aperture of the control tube. Kirby teaches a method of compensating for mineral deposit build-up by using an adjustable aperture in the base of the control tube. The adjustable aperture may be enlarged to compensate for accumulation of mineral deposits therein. However, frequent adjustment may be necessary in areas in which the domestic water supply is hard or corrosive. The Kirby system also has a rigid mount for attaching the system to the toilet flush tank. The mounting system described would thus be difficult to adapt to the wide variety of modern flush tank shapes. The requirement for a variety of mounts to accommodate a variety of flush tank designs may increase the production costs for such monitoring apparatus.

Accordingly, it is an object of the present invention to provide a flush tank monitor system which is reliable and does not require frequent maintenance and adjustment.

It is another object of the present invention to provide a flush tank monitor system adaptable to a wide variety of flush tank designs.

It is a further object of the present invention to provide a flush tank monitor system which is easy to install.

SUMMARY OF THE INVENTION

The present invention is directed to an improved water level monitoring apparatus. The apparatus comprises a sensing system electrically connected to an alarm system. The sensing system includes a control tube having a fluid connection with the water in the flush tank. The water level in the tube is the same as the water level in the flush tank when the flush tank is filled. A float inside the control tube responds to changes in water level in the control tube. The float has a signal system attached to it which communicates with the alarm system when the water level in the control tube reaches a predetermined level. The control tube has a aperture in its base. The float has a rod attached to it which extends throughout the aperture leaving sufficient clearance so that water may drain through the aperture when the flush tank is emptied. The motion of the rod in the aperture as the float responds to changes in water level prevents a build-up of mineral deposits in the aperture.

The sensing system and the alarm system are attached to opposite ends of a flexible belt. The apparatus may be mounted on the tank by draping the belt over the tank rim so that the sensing system is suspended in the tank and the alarm system is suspended outside of the tank. The vertical position of the sensing system in the tank may be adjusted by altering the position of the belt on the tank rim.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below serve to explain the principles of the invention.

DETAILED DESCRIPTION OF THE INVENTION

Figure 1:
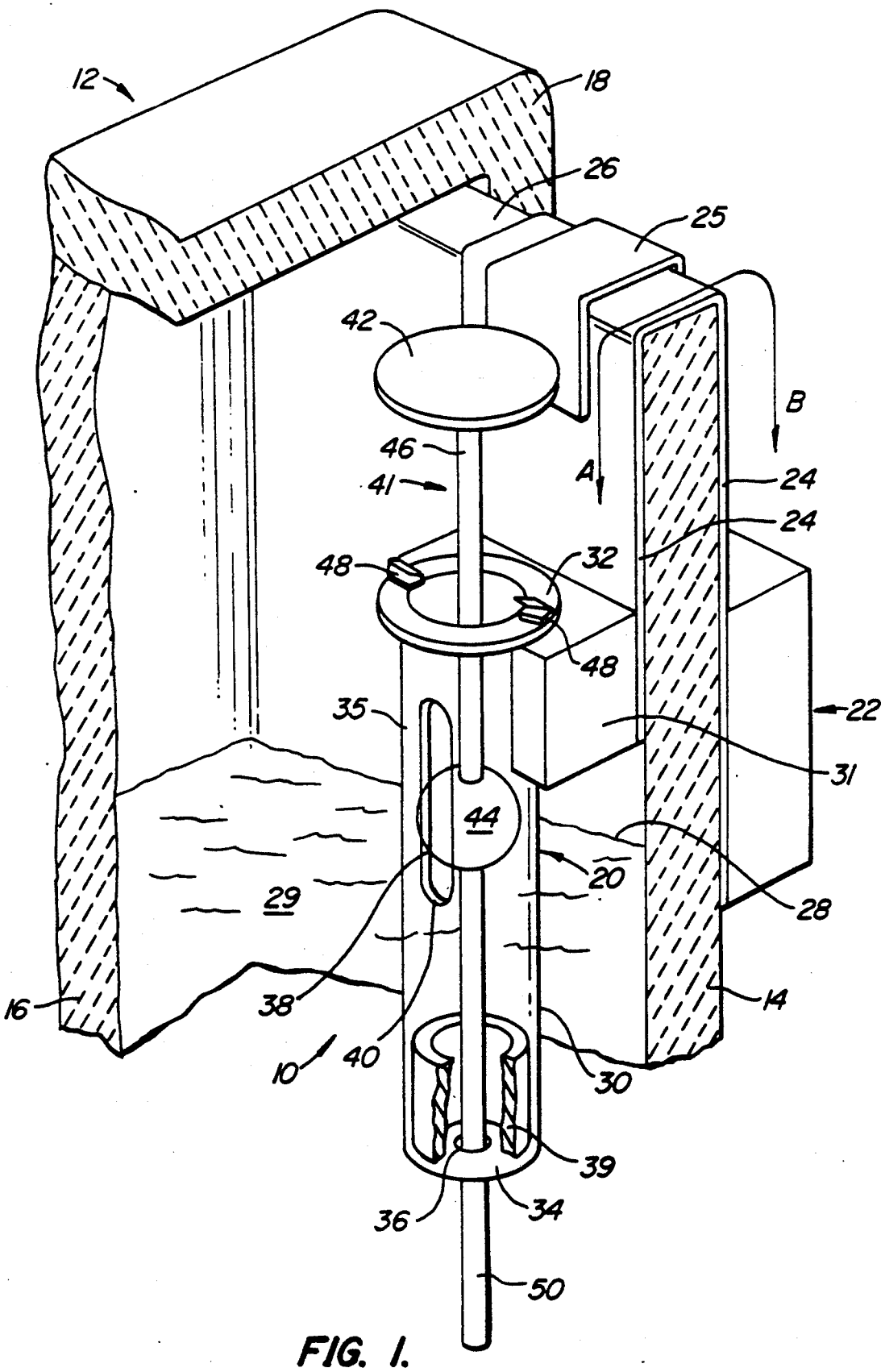
FIG. 1 is a schematic illustration of a monitoring apparatus according to the present invention mounted on a toilet flush tank. Portions of the tank and the apparatus have been removed for clarity.

Referring now to the drawings, in which like parts have like reference numerals, FIG. 1 illustrates a monitoring apparatus 10 mounted in a toilet flush tank 12. The tank has walls 14 and 16, and a top 18. The monitor 10 comprises a sensing system 20 and an alarm system 22. The sensing system 20 and the alarm system 22 are attached to a flexible belt 24. The monitor 10 is mounted in flush tank 12 by draping it over tank rim 26. The sensing system 20 is thus suspended in tank 12 and alarm system 22 is suspended outside of tank 12. Belt 24 is maintained in position by a clip 25.

The sensing system 20 includes a control tube 30. An adaptor member 31 is used to attach control tube 30 to belt 24. The adaptor member adapts the curved form of control tube 30 to the flat form of belt 24. The control tube 30 has a top rim 32. The base 34 of control tube 30 has a circular aperture 36 therein. The wall 35 of control tube 20 includes an elongated aperture 38. The aperture 38 in tube 30 allows water to enter the tube when the water level 28 in tank 20 rises above its base 40. The aperture 36 permits water to drain from control tube 30 when the water level in tank 12 falls below the level of base 40 of aperture 38. A cylindrical metal ballast weight 39 prevents control tube 30 from floating and maintains it in a substantially vertical position at all phases of the toilet flush cycle.

The sensing system 20 further includes a signal system 41. The signal system 41 comprises a metal cap 42 attached to a float 44 by a rod 46. Electrical contacts 48 are attached to top rim 32 of control tube 30. The signal system 41 may be electrically connected with alarm system 22 by wires or other electrical conductors (not shown) connected to electrical contacts 48 and embedded in belt 24 and adaptor member 31. The alarm system 22 may include an alarm device (not shown), such as a buzzer, and an electrical supply (not shown), such as a battery.

A rod 50 attached to the base of float 44 extends downwards through aperture 36 in base 34 of control tube 30. The rod 50 is sufficiently long that it extends through aperture 36 even when float 44 is at its highest level in control tube 30.

The monitoring system operates as follows: when the toilet flush cycle is initiated the water 29 is drained rapidly from the tank, and the water level 28 falls rapidly below the base 34 of control tube 30. Aperture 36 in control tube 30 is sufficiently constricted by rod 50 that water may drain relatively slowly from the tube. As water drains from control tube 30, the float 44 falls and thus the cap 42 falls towards top rim 32. If the toilet flush tank mechanism functions normally, water level 28 will begin to rise and reach the base 34 of control tube 30 before the water has completely drained therefrom. The float 44 will thus be prevented from falling further. If the flushing mechanism does not function normally and flush tank 12 does not refill, float 44 will continue to fall and cap 42 will close electrical contacts 48 to complete an alarm signal circuit in alarm system 22. The drain rate of control tube 22 is determined by the dimensions of aperture 36 and rod 50. The vertical position of control tube 20 in tank 12 determines the time taken for the water level 28 to reach control tube 20 after tank 12 begins to refill.

Figure 2:
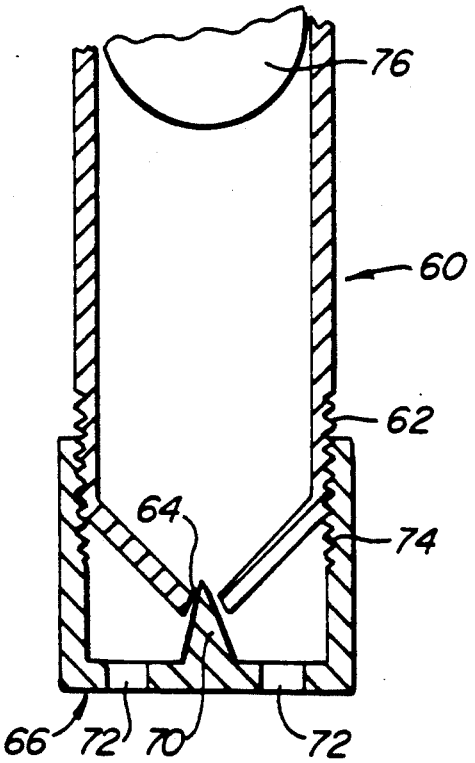
PRIOR ART FIG. 2.
FIG. 2 is a schematic cross section illustrating a water drainage aperture system for a control tube according to the prior art.
Figure 3:
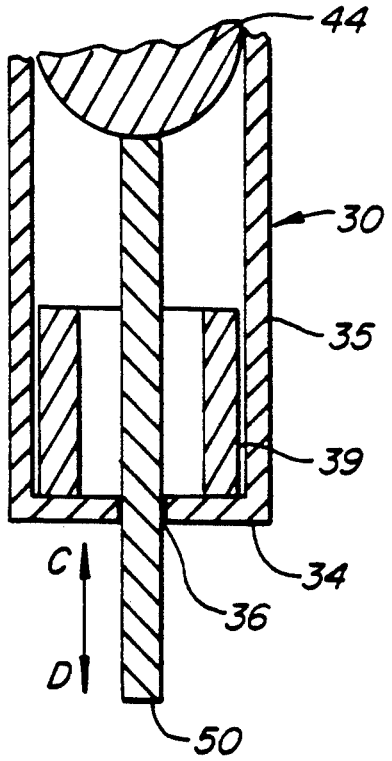
FIG. 3 is a schematic cross section illustrating a self cleaning drainage aperture for a control tube according to the present invention.
Figure 4:
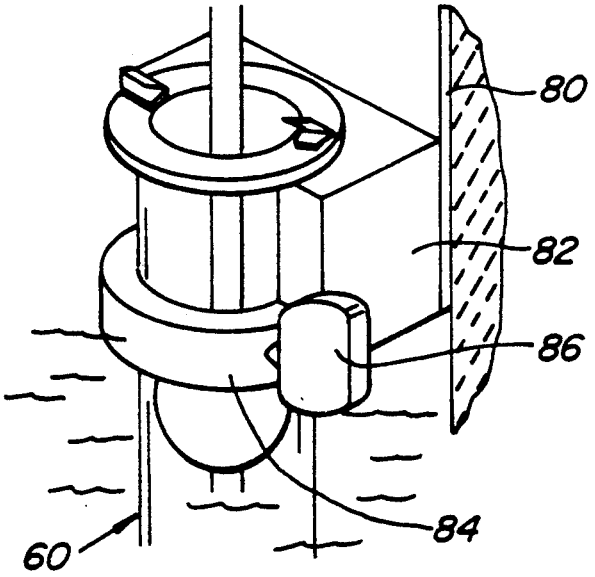
PRIOR ART FIG. 4.
FIG. 4 is a schematic cross section illustrating a prior art method for adjusting the vertical position of the control tube.

The basic operating principle described above may be referred to as a fluid delay switch. FIGS. 2 through 4 serve to further illustrate the improvements of the present invention.

Referring now to FIG. 2, which illustrates the drainage aperture described by Kirby in U.S. Pat. No. 3,984,877, a control tube 60 has a threaded end 62 and a drainage aperture 64. An adjusting cap 66 has a needle 70 which locates in aperture 64. The cap 66 has drain holes 72 to allow the rapid drainage of water. The cap 66 is attached to tube 60 by a mating thread 74. The constriction of the aperture 64 may be varied by turning cap 66 on tube 60 to adjust the position of needle 70. Kirby teaches that an advantage of this system is that the drainage rate may be readjusted when mineral deposits accumulate in aperture 64. Thus periodic maintenance is implicit in the Kirby system.

The drainage system of the present invention is illustrated in detail in FIG. 3. Here rod 50 is used to constrict aperture 36. As the system is operated, float 44 rises and falls; thus, rod 50 moves in a reciprocal manner in aperture 36 during the flush cycle. This is indicated by arrows C and D. The reciprocal motion of rod 50 provides a self-cleaning mechanism which prevents the accumulation of mineral deposits in aperture 36. The self-cleaning mechanism may be most effective if the tube is made from a low coefficient of friction polymer such as a fluorinated hydrocarbon polymer. The self cleaning system of the present system eliminates the need for periodic maintenance of sensing system 20.

FIG. 4 illustrates the system taught by Kirby for adjusting the vertical position of the control tube in the flush tank. The Kirby monitor includes a rigid mounting bracket 80. Control tube 60 is attached to bracket 80 by an adaptor member 80 and a guide ring 84. A clamping screw 86 is inserted through guide ring 84 to clamp control tube 60 in position. Height adjustment is accomplished by loosening screw 86 and moving tube 60 in guide ring 84.

The height adjusting system of the present invention is illustrated in FIG. 1. Here control tube 30 is fixedly attached to adaptor member 31. The vertical position of control tube 30 is adjusted by removing clip 25 and pulling belt 24 in either of the directions indicated by arrows A and B. When the adjustment is completed clip 25 is replaced to hold belt 24 in position. The clip 25 serves additionally to prevent damage to belt 24 by flush tank top 18.

The present invention offers improvements to the flush tank monitor which simplify installation and improve reliability. The simplified construction combined with the use of plastics for the majority of the important components offer the possibility of reducing manufacturing costs. It is believed that the present invention will increase the public acceptance of the flush tank monitor apparatus and contribute to saving water resources.

The present invention has been described in terms of the preferred embodiment. The invention, however, is not limited to the embodiment depicted and described. Rather, the scope of the invention is defined by the appended claims.

What is claimed is:

1. In an apparatus for monitoring the level of water in a toilet flush tank, wherein the apparatus includes sensing means and alarm means; said sensing means including a control tube having a top and a base, said control tube being in fluid connection with said flush tank and being normally filled with water; said sensing means further including a float in said control tube responsive to the water level therein, and signal means attached to said float and electrically connected to said alarm means for indicating when said water level reaches a predetermined level; and said base including an aperture for draining water from said control tube; the improvement comprising:

self-cleaning means for preventing a build-up of mineral deposits in said aperture, said self cleaning means including a rod attached to said flat and extending downwards through said aperture, said rod being free to move in said aperture responsive to the water level in said tube, whereby the motion of said rod in said aperture substantially prevents the accumulation of mineral deposits therein; and flexible mounting means for adjustably suspending the sensing means in said flush tank.

2. The apparatus of claim 1 wherein said rod and said tube are made from a plastic material.

3. The apparatus of claim 2 wherein said plastic material is a fluorinated hydrocarbon polymer.

4. The apparatus of claim 1 wherein said flexible mounting means includes:

a belt of a flexible material, said belt having attached at one end thereof said sensing means, and at the other end thereof said alarm means;

said sensing means having ballast means attached thereto for preventing said sensing means from floating; and;

said belt being mounted on a rim of said flush tank with said sensing means suspended inside of said tank and said alarm means suspended outside of said tank, whereby the vertical position of said sensing means in said tank may be adjusted by adjusting the position of said belt on said rim.

5. The apparatus of claim 4 wherein said belt includes electrical conductors for electrically connecting said sensing means to said alarm means.

6. The apparatus of claim 5 wherein said ballast means is a metal cylinder located inside of said control tube.

7. The apparatus of claim 6 further including fastening means for maintaining the position of said belt on said rim.

8. The apparatus of claim 7 wherein said fastening means includes at least one clip.

* * * * *

UNITED STATES PATENT AND TRADEMARK OFFICE

CERTIFICATE OF CORRECTION

PATENT NO. : 5,144,700
DATED : September 8, 1992
INVENTOR(S) : Michel M. Martin

It is certified that error appears in the above-indentified patent and that said Letters Patent is hereby corrected as shown below:

In column 6, (claim 1) line change "flat" to "float".

Signed and Sealed this

Seventh Day of September, 1993

Bruce Lehman

*Attest:*

BRUCE LEHMAN

*Attesting Officer*

*Commissioner of Patents and Trademarks*